US008732865B2

(12) United States Patent
Ishikawa et al.

(10) Patent No.: US 8,732,865 B2
(45) Date of Patent: May 27, 2014

(54) PANTS

(75) Inventors: Emiko Ishikawa, Otsu (JP); Michiko Yoshida, Musashino (JP)

(73) Assignee: Toray Industries, Inc., Tokyo (JP)

( * ) Notice: Subject to any disclaimer, the term of this patent is extended or adjusted under 35 U.S.C. 154(b) by 581 days.

(21) Appl. No.: 11/918,990

(22) PCT Filed: Apr. 13, 2006

(86) PCT No.: PCT/JP2006/307811

§ 371 (c)(1),
(2), (4) Date: Nov. 20, 2007

(87) PCT Pub. No.: WO2006/115066

PCT Pub. Date: Nov. 2, 2006

(65) Prior Publication Data

US 2009/0031470 A1 Feb. 5, 2009

(30) Foreign Application Priority Data

Apr. 21, 2005 (JP) ..... 2005-123353
Feb. 3, 2006 (JP) ..... 2006-026636

(51) Int. Cl.
*A41D 1/06* (2006.01)
*A41B 9/00* (2006.01)

(52) U.S. Cl.
USPC ..... 2/227; 2/401

(58) Field of Classification Search
USPC ..... 2/401, 409, 227, 236, 237, 69, 400, 2/405, 408; 450/115, 123, 124, 131, 151, 450/155, 132, 122, 95, 126, 156, 99
See application file for complete search history.

(56) References Cited

U.S. PATENT DOCUMENTS

| | | | | | |
|---|---|---|---|---|---|
| 2,250,218 | A | * | 7/1941 | Cadous | 2/401 |
| 2,344,374 | A | * | 3/1944 | Stephens | 450/104 |
| 3,068,871 | A | * | 12/1962 | Rapp | 450/95 |
| 3,127,896 | A | * | 4/1964 | Puliafico | 450/95 |
| 3,177,875 | A | * | 4/1965 | Garson | 450/116 |
| 3,214,770 | A | * | 11/1965 | Smith | 2/227 |
| 3,236,241 | A | * | 2/1966 | Alexander et al. | 450/131 |
| 3,246,342 | A | * | 4/1966 | Pagano | 2/227 |
| 3,298,373 | A | * | 1/1967 | Marchisella | 450/99 |
| 3,526,229 | A | * | 9/1970 | Blair | 450/118 |
| 3,566,879 | A | * | 3/1971 | Braun | 450/117 |
| 3,824,812 | A | * | 7/1974 | Matthews et al. | 66/177 |
| 3,835,866 | A | * | 9/1974 | Brooks | 450/123 |
| 3,894,542 | A | * | 7/1975 | Sacristan | 450/123 |

(Continued)

FOREIGN PATENT DOCUMENTS

| | | | |
|---|---|---|---|
| JP | 3008616 | U | 12/1994 |
| JP | 9-13206 | A | 1/1997 |
| JP | 3089647 | U | 8/2002 |
| JP | 2004-332153 | A | 11/2004 |

*Primary Examiner* — Alissa L Hoey
(74) *Attorney, Agent, or Firm* — Birch, Stewart, Kolasch & Birch, LLP

(57) ABSTRACT

[Problem to be Solved] To provide pants which look like ordinary pants, have a buttocks supporting effect and assure excellent wearing comfort.
[Solution] Pants, in which a lining fabric covering the region ranging from the buttock portion of the back body through the sidelines to partial portions of the front body is attached inside the garment fabric of the front and back bodies, with fasteners interposed between the lining fabric and the garment fabric, the lining fabric and the garment fabric being sewn to each other at the waist belt, the crotch and the side seam allowances for integration.

3 Claims, 9 Drawing Sheets

(56) References Cited

U.S. PATENT DOCUMENTS

| | | | | |
|---|---|---|---|---|
| 4,069,513 | A * | 1/1978 | Shiller et al. | 2/227 |
| 4,325,379 | A * | 4/1982 | Ozbey | 450/116 |
| 4,525,420 | A * | 6/1985 | Imai et al. | 428/372 |
| 4,698,847 | A * | 10/1987 | Yoshihara | 2/69 |
| 5,010,595 | A * | 4/1991 | Stradley | 2/227 |
| 5,250,351 | A * | 10/1993 | Kondou et al. | 442/306 |
| 5,598,586 | A * | 2/1997 | Munjone | 2/237 |
| 5,762,535 | A * | 6/1998 | Nishiyama et al. | 450/98 |
| 5,787,732 | A * | 8/1998 | Perron et al. | 66/177 |
| 5,888,118 | A * | 3/1999 | Kishi | 450/122 |
| 5,916,829 | A * | 6/1999 | Girard et al. | 442/244 |
| 6,035,448 | A * | 3/2000 | Thomson | 2/227 |
| 6,080,038 | A * | 6/2000 | Sano | 450/155 |
| 6,205,591 | B1 * | 3/2001 | Wheeler et al. | 2/227 |
| 6,367,086 | B1 * | 4/2002 | Woodard | 2/237 |
| 6,403,216 | B1 * | 6/2002 | Doi et al. | 428/364 |
| 6,454,628 | B1 * | 9/2002 | Shunichirou | 450/155 |
| 6,728,973 | B1 * | 5/2004 | Webley et al. | 2/400 |
| 6,874,337 | B2 * | 4/2005 | Uno et al. | 66/177 |
| 7,087,032 | B1 * | 8/2006 | Ikeda | 602/19 |
| 7,143,453 | B2 * | 12/2006 | Duran | 2/409 |
| 7,341,500 | B2 * | 3/2008 | Horn et al. | 450/95 |
| 7,509,822 | B2 * | 3/2009 | Ishida et al. | 66/177 |
| 7,559,093 | B2 * | 7/2009 | Sudo et al. | 2/69 |
| 7,730,552 | B2 * | 6/2010 | Ota et al. | 2/69 |
| 2002/0007507 | A1 * | 1/2002 | Duran | 2/406 |
| 2002/0115378 | A1 * | 8/2002 | Nagaoka | 450/115 |
| 2004/0111781 | A1 * | 6/2004 | Miyake et al. | 2/69 |
| 2005/0142986 | A1 * | 6/2005 | Belpaume | 450/99 |
| 2005/0239370 | A1 * | 10/2005 | Oyama et al. | 450/99 |
| 2007/0067892 | A1 * | 3/2007 | Oyama et al. | 2/227 |
| 2007/0256217 | A1 * | 11/2007 | Takamoto et al. | 2/401 |
| 2008/0194181 | A1 * | 8/2008 | Sudo et al. | 450/123 |
| 2008/0201830 | A1 * | 8/2008 | Ishida et al. | 2/467 |
| 2009/0077720 | A1 * | 3/2009 | Shinomiya | 2/401 |

* cited by examiner

PANTS

TECHNICAL FIELD

The present invention relates to pants effective for supporting the buttocks.

BACKGROUND ART

Highly stretchable pants are comfortable to wear but cannot create a beautiful silhouette. Especially since they cannot control the abdomen or the buttocks, the wearer's body shape is often revealed, not allowing a beautiful shape to be created. Further, if a controlling undergarment such as a girdle is worn under the pants, a body shape can be created, but since such underwear squeezes the wearer's body, it is not comfortable to wear. To solve these problems, recently pants and skirts with stretchable lining fabrics sewn to their wrong sides intended for body shaping are abundantly commercially available.

On the other hand, the prior art proposals include pants with a power net fabric sewn to the wrong side of the back body (see Patent Document 1), pants or a skirt having a girdle suspended inside (see Patent Document 2), pants in which any of variously formed stretchable knit lining fabrics intended for body shaping is sewn to the front and back bodies inside the pants (see Patent Documents 3, 4, 5 and 6), etc.

[Patent Document 1] JP3098702U
[Patent Document 2] JP2670567B
[Patent Document 3] JP3080399U
[Patent Document 4] JP2003-268606A
[Patent Document 5] JP2005-15930A
[Patent Document 6] WO2005/029987A

Problems to be Solved by the Invention

However, the pants with a power net fabric sewn to the wrong side of the back body, described in Patent Document 1, are little effective for supporting the buttocks, since the lining fabric and the garment fabric are almost dimensionally equal to each other.

On the other hand, the pants or a skirt having a girdle suspended inside, described in Patent Document 2, is less comfortable to wear and cannot be easily put on or taken off, though it can give the same effect as given by a tightly controlling undergarment. Further, Patent Documents 3, 4 and 5 are respectively intended to provide an effect of supporting the buttocks by overlaying and sewing a V-shaped powerful power net, but joining or sewing it is troublesome while the intended effect remains small for the troublesome effort. Patent Document 6 discloses pants having a non-stretchable belt-like patch applied to a highly stretchable lining fabric. However, since the patch is non-stretchable, the buttocks shape tends to be disfigured.

Furthermore, there are commercially available pants with body shaping patches, and when those with a lining fabric for the back body only and those with a lining fabric for the front body only, respectively sewn at sides, were worn experimentally, they were twitched at the sewn portions awkwardly.

The object of this invention is to overcome the disadvantages of the prior art as described above, by providing pants that look like ordinary pants, are effective for supporting the buttocks, further can shape the region ranging from the sides to the abdomen of the wearer, and are excellent in wearing comfort.

Means for Solving the Problems

To achieve the aforesaid object, the pants of this invention comprise the following constitutions.

(1) Pants, characterized in that a lining fabric covering the region ranging from the buttock portion of the back body through the sidelines to partial portions of the front body is attached inside the garment fabric of the front and back bodies.

(2) Pants, according to (1), wherein the garment fabric and the lining fabric are joined to each other at the waistline and the crotch.

(3) Pants, according to (1), wherein the garment fabric and the lining fabric are joined to each other at the waistline and the crotch and sewn or fastened to partial portions of the side seam allowances through fasteners.

(4) Pants, according to any one of (1) through (3), wherein the garment fabric and/or the lining fabric is a woven or knitted fabric stretchable in the warp yarns direction and/or in the weft yarns direction.

(5) Pants, according to any one of (1) through (4), wherein the garment fabric and/or the lining fabric is a polyester-based stretchable woven fabric in which composite multi-filaments, each consisting of a polyester mainly composed of polytrimethylene, terephthalate and another polyester bonded to each other side by side to extend in the filament length direction, are used as at least either the warp yarns or the weft yarns.

(6) Pants, according to any one of (1) through (5), wherein the width and/or length of the lining fabric is set to correspond to 99% to 85% of that of the garment fabric.

(7) Pants, according to any one of (1) through (6), wherein the left and right pocket patches of the front body are attached in the respectively continuous regions ranging from the sidelines to the placket front.

(8) Pants, according to (7), wherein the left and right pocket patches are respectively made from a slightly stretchable woven or knitted fabric.

(9) Pants, according to (7) or (8), wherein the left and right front portions of the lining fabric are overlaid on the left and right pocket patches by 10 to 20 cm each, and the left and right front ends of the lining fabric are sewn to the left and right pockets.

(10) Pants, according to any one of (1) through (9), wherein pieces of the lining fabric are joined in the back body at least at one or more places for draping to suit the roundness of the buttocks.

(11) Pants, according to anyone of (1) through (10), wherein pieces of the lining fabric are joined in the back body at least at one or more places, and highly extensible seams and/or highly extensible sewing machine threads are used for the joining.

(12) Pants, according to anyone of (1) through (11), wherein a belt-like buttocks supporting patch inclining obliquely upward from below the hipline of the back body toward the front body is attached to the lining fabric.

(13) Pants, according to (12), wherein the lining fabric and the buttocks supporting patch have extension rates in a range from 30 to 200% and extension recovery rates in a range from 80 to 100%, and they are almost equal to each other in extension rate and extension recovery rate.

(14) Pants, according to (12) or (13), wherein a satin net with a bursting strength of 200 to 260 kPa is used as the lining fabric and a power net with a bursting strength of 261 to 320 kPa is used as the buttocks supporting patch.

(15) Pants, according to anyone of (12) through (14), wherein the width of the buttocks supporting patch gradually increases from a range of 4 to 7 cm at the back center to a range of 5 to 10 cm at the ends of the buttocks supporting patch on the front body.

(16) Pants, according to any one of (1) through (6), wherein a belt-like abdomen suppressing patch for covering the region from the crotch to the waist portion of the front body is attached to the wrong side of the garment fabric.

(17) Pants, according to (16), wherein the belt-like abdomen suppressing patch is sewn to the garment fabric and the lining fabric at the waist portion of the front body and at the crotch and is formed to be continuous from the back body.

(18) Pants, according to (16) or (17), wherein the belt-like abdomen suppressing patch is made of the same material as that of the lining fabric.

(19) Pants, according to any one of (16) through (18), wherein the width of the belt-like abdomen suppressing patch gradually increases from a range of 8 to 15 cm at the crotch to a range of 12 to 25 cm at the waist portion.

Effects of the Invention

This invention can provide pants that look like ordinary pants, are effective for supporting the buttocks, can be used for shaping the sides and the abdomen and are excellent in wearing comfort. Especially even when the pants are light or white colored, the underwear lines are not noticeable from outside.

Further, in another mode of this invention, the pants have not only a buttocks supporting effect but also an abdomen shaping effect.

MEANINGS OF SYMBOLS

Figure 1:
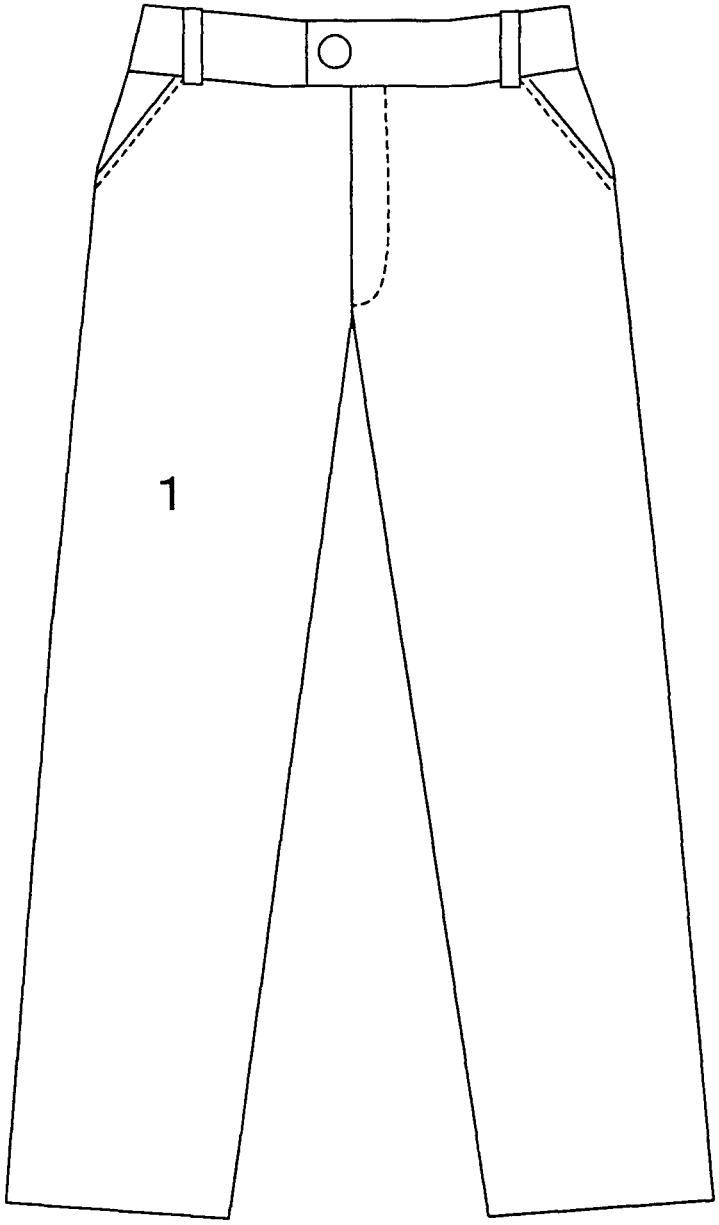
FIG. 1 shows the front body viewed from the front side, of the pants of this invention as a first embodiment.

1: front body garment fabric
2: back body garment fabric
3: lining fabric
4: sideline
5: waistline
6: crotch
7: back center line
8: buttocks supporting patch
9: front center line (placket front)
10: fastener
11: pocket patch
12: front end of lining fabric
13: overlying portion between lining fabric and pocket patch
14: side seam allowance
15: sewing yarn
16: abdomen suppressing patch
A: length of fastener
B: width of fastener
C: width of garment fabric between back center line and sideline
D: width of lining fabric at the same position as that of C
E: length of garment fabric from waistline to crotch
F: length of lining fabric at the same position as that of E

THE BEST MODES FOR CARRYING OUT THE INVENTION

The pants of this invention are described below in detail in reference to the first to third embodiments shown in the drawings.

Figure 2:
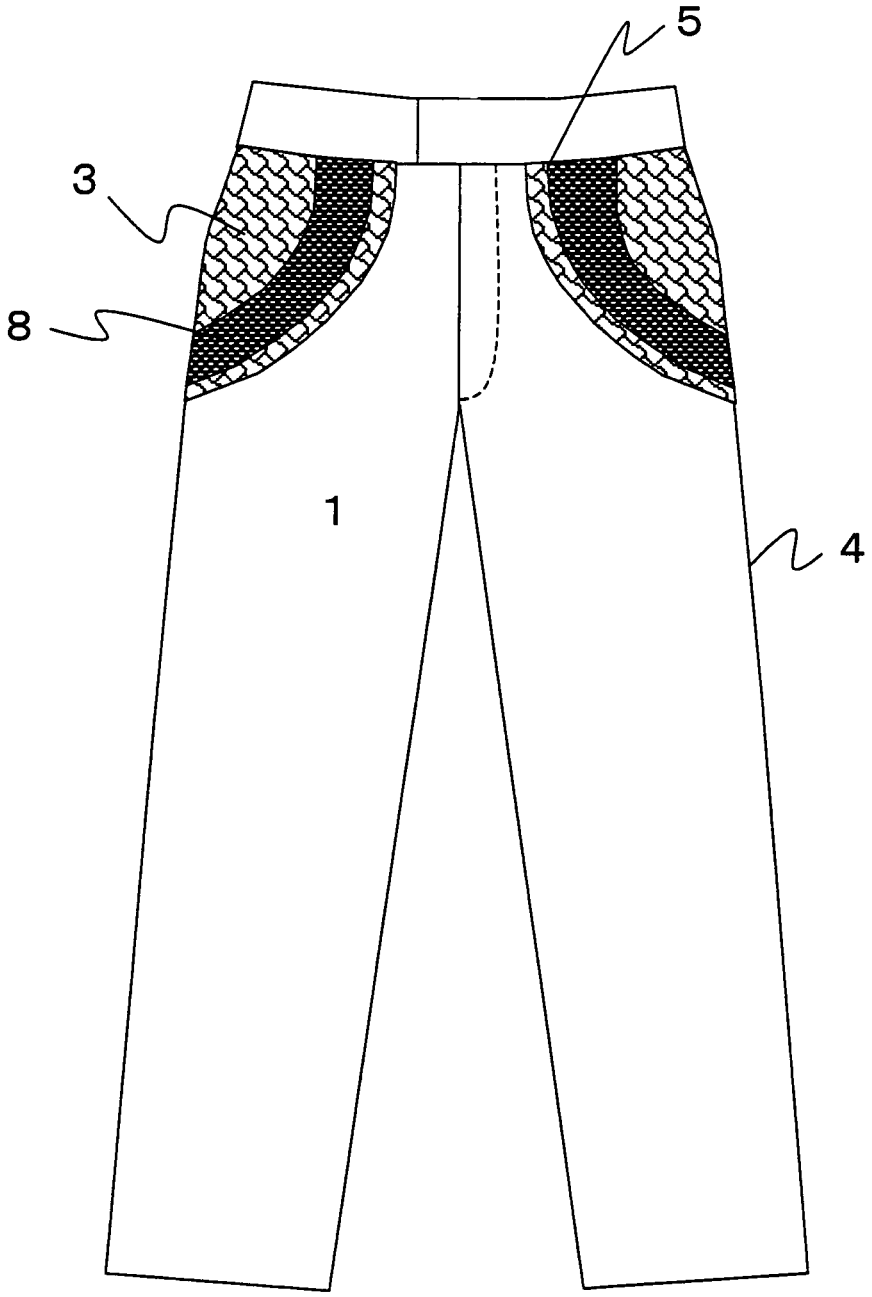
FIG. 2 shows the front body viewed from the back side (inside), of the pants of this invention as the first embodiment.
Figure 3:
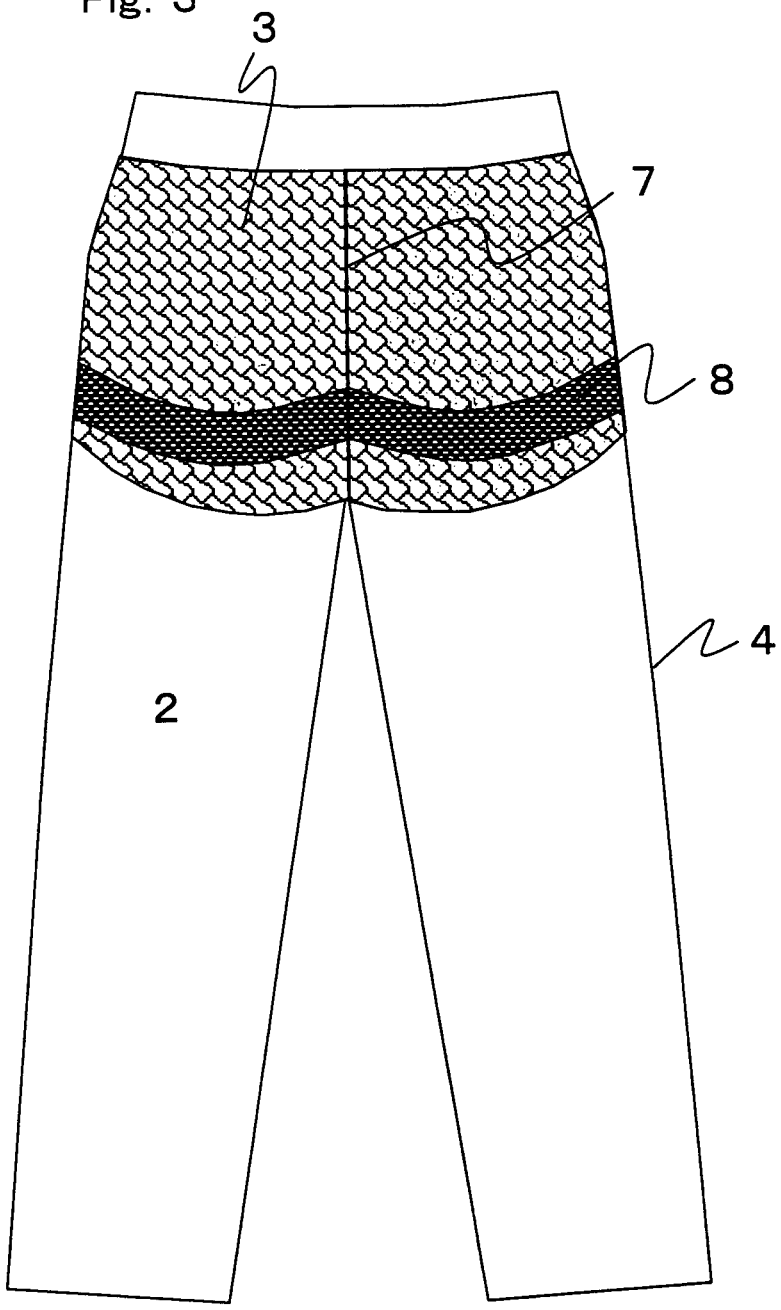
FIG. 3 shows the back body viewed from the back side (inside), of the pants of this invention as the first embodiment.
Figure 4:
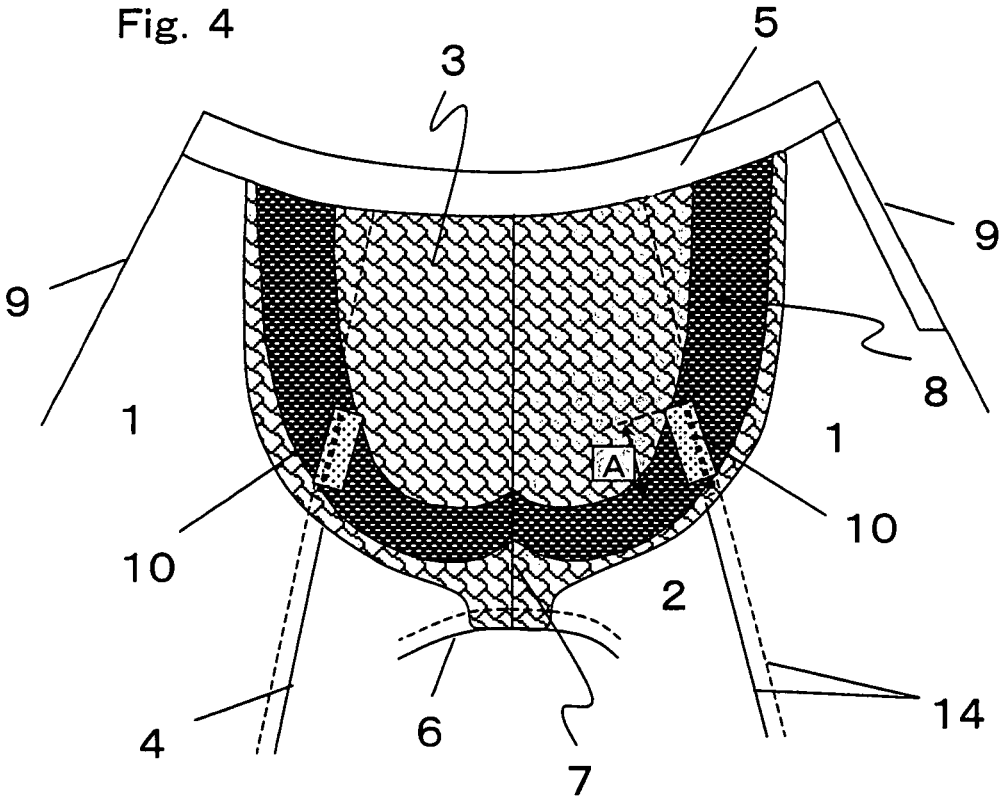
FIG. 4 is a development showing the back side (inside) of the pants of this invention as the first embodiment, where the seams at the crotch and the front center are removed.
Figure 5:
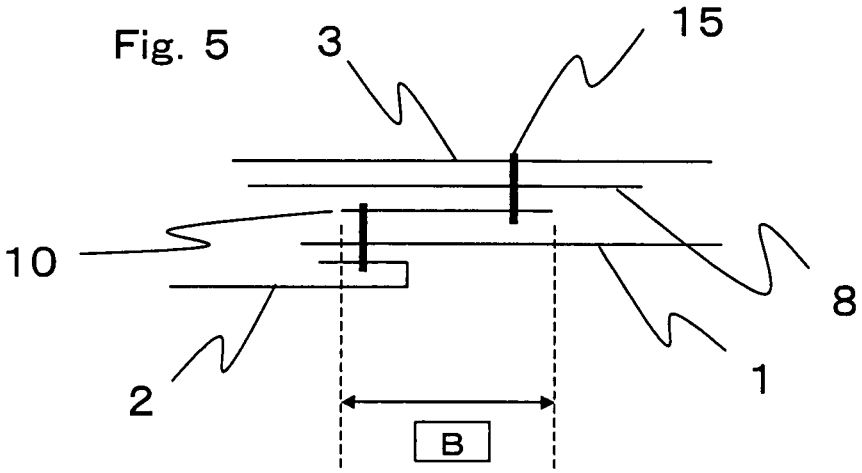
FIG. 5 shows an arrangement of a fastener used in the pants of this invention.
Figure 6:
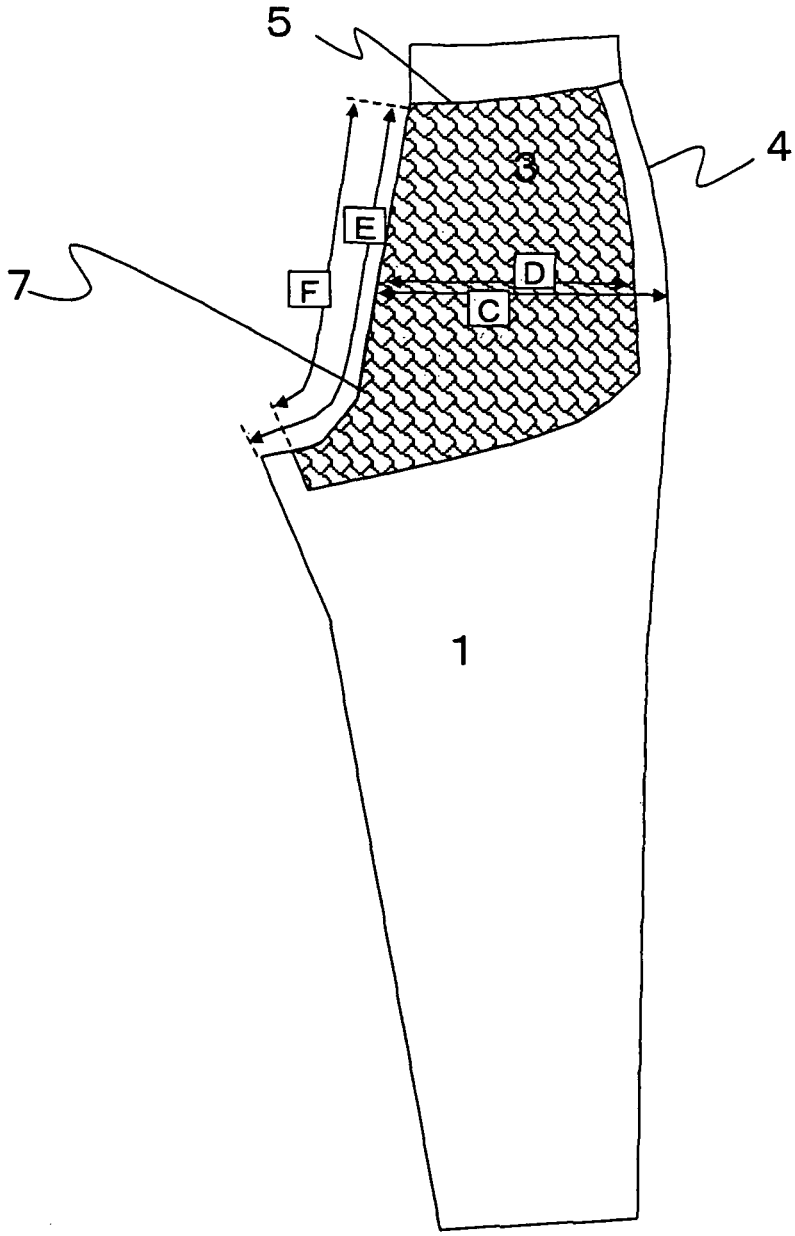
FIG. 6 shows an example of measuring the widths and lengths of the garment fabric and the lining fabric on a back right body paper pattern of the pants of this invention.
Figure 7:
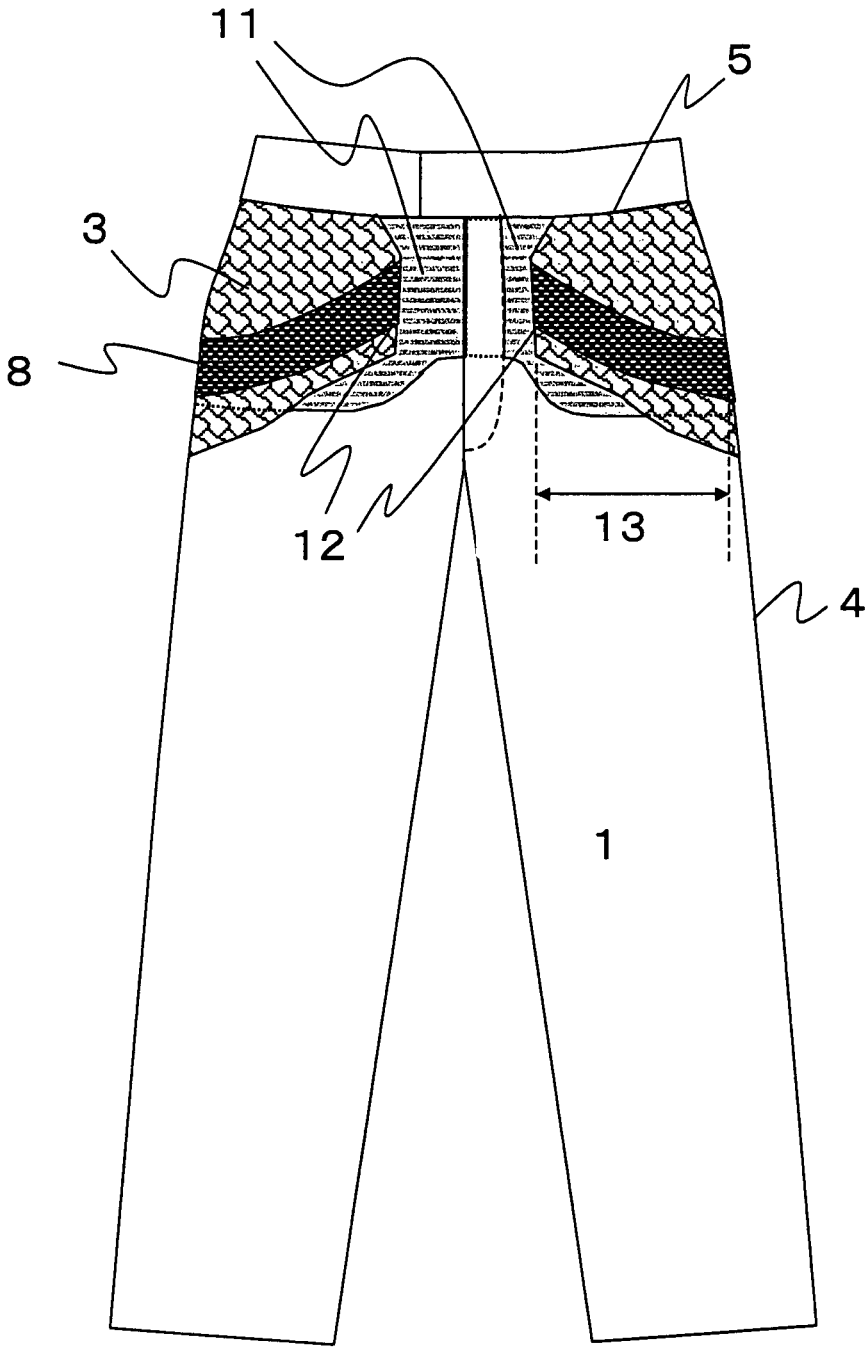
FIG. 7 shows the front body viewed from the back side (inside), of the pants of this invention as a second embodiment.
Figure 8:
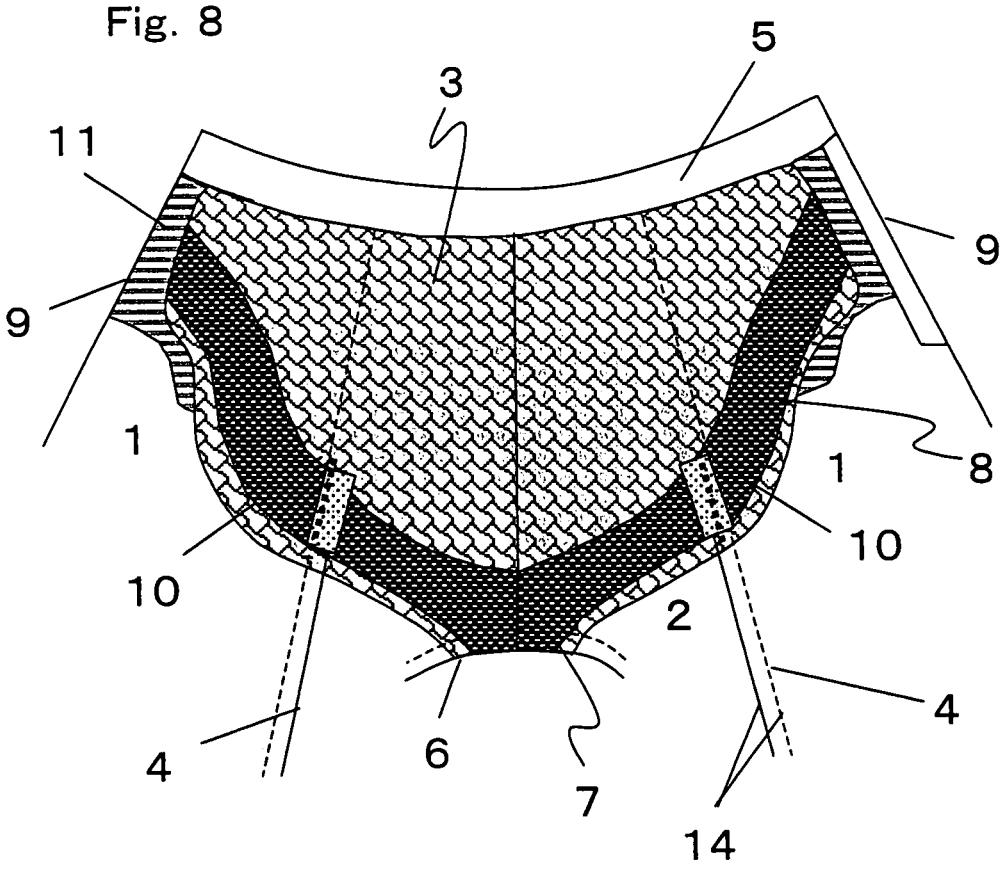
FIG. 8 shows the back body viewed from the back side (inside), of the pants of this invention as the second embodiment.
Figure 9:
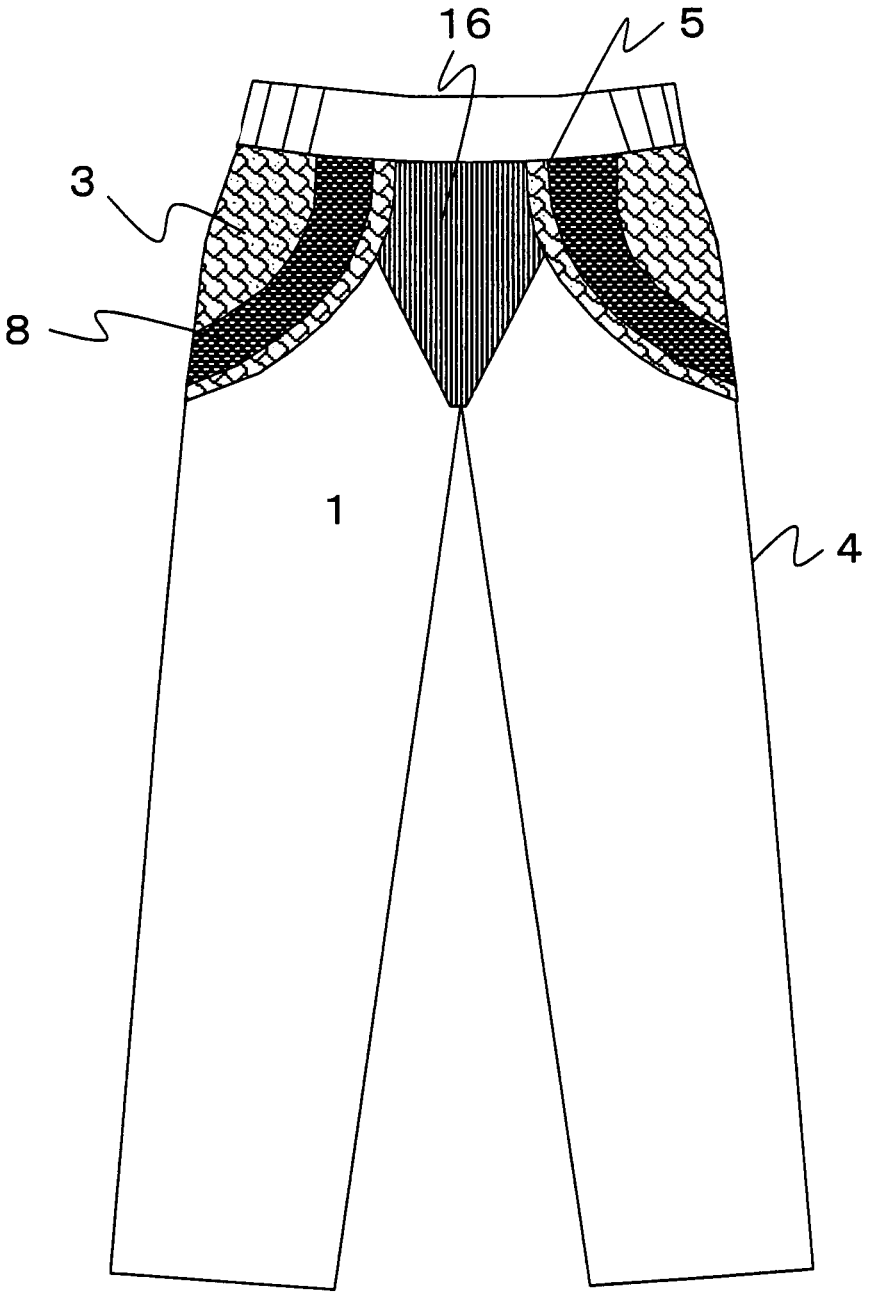
FIG. 9 shows the front body viewed from the back side (inside), of the pants of this invention as a third embodiment.
Figure 10:
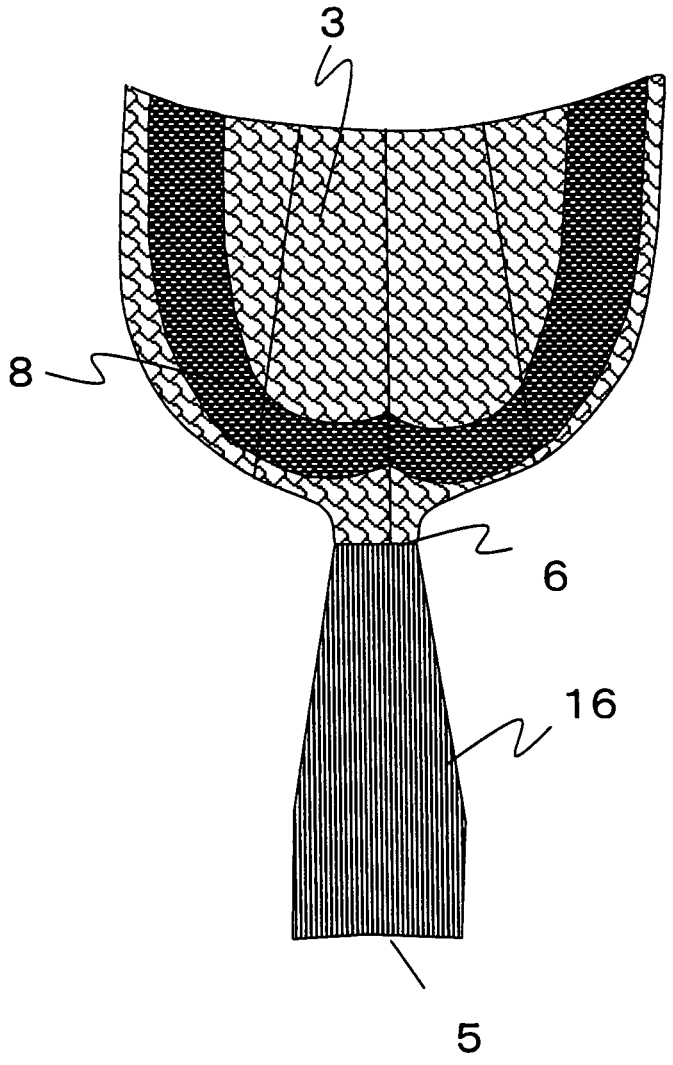
FIG. 10 shows the lining fabric and the abdomen suppressing patch used in the pants of this invention as the third embodiment, respectively not yet sewn to the pants.

FIG. 1 shows the pants of this invention as a first embodiment, viewed from the front side. FIGS. 2 and 3 show the front body and the back body of the pants of this invention as the first embodiment, respectively viewed from the back side with the pants turned inside out. FIG. 4 is a development of the back side of the pants, where the seams at the crotch and the front center are removed. FIG. 5 is a sectional view showing a fastener portion of FIG. 4, where the fastener 10 is provided between the front body garment fabric 1 and the back body garment fabric 2 on one hand and the buttocks supporting patch 8 on the other hand. FIG. 6 shows an example of measuring the widths and lengths of the garment fabric and the lining fabric on a back right body paper pattern. FIGS. 7 and 8 show the front body and the back body of the pants of this invention as a second embodiment, respectively viewed from the back side with the pants turned inside out. Further, FIG. 9 shows the front body of the pants of this invention as a third embodiment, viewed from the back side with the pants turned inside out. FIG. 10 shows the lining fabric and the abdomen suppressing patch used in the pants of this invention as the third embodiment, not yet sewn to the pants.

The pants of this invention can lift the buttocks upward and obliquely forward from the gluteal fold, since the lining fabric 3 covering the region ranging from the buttock portion of the back body 2 through the sidelines 4 to partial portions of the front body 1 is joined to the garment fabric at the waistline 5 and the crotch 6 inside the garment fabric of the front and back bodies as shown in FIGS. 2, 3 and 4. The gluteal fold referred to here means the boundary portion between the buttocks and the thighs. Further, the pants of this invention are expected to be effective also for tightening the wearer's sides to partially lift the waste flesh of the wearer's sides, since the attached lining fabric is continuously formed from the back body to the front body. On the contrary, it is not preferred that the lining fabric is attached to cover the entire inner circumference of the pants, since the pants become too tight like the controlling undergarment and cannot be easily put on or taken off. Furthermore, if lining fabric is attached to the back body only, there is no effect of tightening the wearer's sides at all without creating a beautiful silhouette though it is still effective for supporting the buttocks. Meanwhile, it is preferred that the lining fabric 3 in the first embodiment is formed to have curves swelling outside from the straight lines connecting the crotch 6 with the waistline 5 as shown in FIG. 4. Further, in the second embodiment, as shown in FIGS. 7 and 8, it is preferred that the lining fabric is formed to have curves swelling outside the straight lines connecting the crotch 6 with the front ends 12 of the lining fabric.

Moreover, if the lining fabric 3 is sewn to partial portions of the side seam allowances 14 of the garment fabric through the fasteners 10 as shown in FIGS. 4 and 5, the portions of the fasteners 10 can freely move without causing the sewn places to be twitched compared with the case where the lining fabric 3 is directly sewn to the side seam allowances of the garment fabric. The fasteners used here can be any articles such as cords, planar fasteners, woven or knitted fabrics, tapes or rubber, if they allow linear or planar fastening by sewing. However, if the thickness of the fasteners 10 is 2 mm or more, the existence of the fasteners 10 can be clearly noticed from outside and the fasteners 10 may be felt as obstacles to impair the wearing comfort when the pants are worn. So, it is preferred that the thickness is less than 2 mm. In view of wearing comfort and supporting effect, it is preferred that the fasteners 10 are about 1 to about 2 cm as the width B shown in FIG. 5 and about 2 to about 6 cm in the length A shown in FIG. 4. The width B of the fasteners 10 corresponds to the gap between the garment fabric and the lining fabric 3. So, if the width is smaller than 1 cm, the lining fabric 3 is allowed to move so slightly that twitching occurs to impair the appearance from outside. So, it is preferred that the width B of the fasteners 10 is 1 cm or more. On the contrary, if the width B of the fasteners 10 is more than 2 cm, the lining fabric 3 is allowed to move so freely as to decrease the effect of supporting the buttocks. So, it is preferred that the width B is 2 cm or less. On the other hand, the length A of the fasteners 10 corresponds to the sewing length between the garment fabric and the lining fabric 3. If the length A is less than 2 cm, fastening at one spot occurs to cause twitching at the portion. On the contrary if the length A of the fasteners 10 is 6 cm or more, the movement of the lining fabric 3 is arrested to reduce the effect of the fasteners and to impair the wearing comfort. In view of the above matters, it is preferred that the fasteners 10 used in this invention are tapes with a width of 1 to 2 cm and a length of 2 to 6 cm obtained by cutting a woven or knitted fabric with about the same extension rate and about the same extension recovery rate as those of the lining fabric 3. If such fasteners 10 are used between the lining fabric 3 and the garment fabric, pants free from any problem in wearing comfort, support effect and appearance can be obtained.

In the pants of this invention, if woven or knitted fabrics stretchable in the warp yarns direction and/or the weft yarns direction are used as the garment fabric and/or the lining fabric 3, remarkable effects can be obtained in all of wearing comfort, motion allowance and appearance.

The stretchable woven or knitted fabrics include a stretchable woven fabric, etc. formed by using elastic fibers (polyurethane fibers, etc.) together with natural fibers such as cotton or wool, regenerated fibers such as rayon, or synthetic fibers such as acrylic fibers or polyester fibers. Further, usable is a polyester-based stretchable woven fabric in which composite multi-filaments, each consisting of a polyester mainly composed of polytrimethylene terephthalate (hereinafter abbreviated as PPT) and another polyester bonded to each other side by side to extend in the filament length direction, are used as at least either the warp yarns or the weft yarns. Side-by-side composite fibers, in which polymers different in intrinsic viscosity, components, copolymerization ratio, etc. are bonded to each other, are crimped due to the differences in elasticity recovery characteristics and shrinkage characteristics. In the case of side-by-side composite fibers involving fibers different in intrinsic viscosity, stress is concentrated in the fiber component higher in intrinsic viscosity when the fibers are spun or stretched, and the two components are differently internally strained. For this reason, due to the difference in elasticity recovery rate after stretching and the difference in heat shrinkage in the heat treatment of the woven fabric, the component higher in intrinsic viscosity shrinks more greatly, and the single fibers are internally strained and three-dimensionally crimped to form coils. It can be said that the diameter of the three-dimensional coils and the number of coils per unit fiber length are decided by the difference in shrinkage (including the difference in elasticity recovery rate) between the component higher in intrinsic viscosity (highly shrinkable component) and the component lower in intrinsic viscosity (low shrinkable component). If the shrinkage difference is larger, the coil diameter is smaller and the number of coils per unit fiber length is larger. The coils required to be formed by crimping for a stretchable fabric are such that the diameter of the coils is small, that the number of the coils per unit fiber length is large (excellent extension properties and good looking), that the coils have good fatigue setting resistance (small coil fatigue setting in spite of frequent extension and contraction and long-sustained stretchability), and that the hysteresis loss of the coils at the time of extension recovery is small (excellent resiliency and good fit). A stretchable fabric excellent in total balance satisfies all of these requirements and has the properties of polyesters such as appropriate firmness, drapability and high color fastness. To satisfy these properties, it is preferred to use a polyester mainly composed of PPT as the highly shrinkable component. PPT refers to a polyester obtained with terephthalic acid as the main acid component and 1,3-propanediol as the main glycol component. The low shrinkable component is not especially limited, if it is a fiber-formable polyester that is good in interfacial adhesion to the highly shrinkable component PPT and stable in yarn formability. Considering mechanical properties, chemical properties and cost, fiber-formable polyethylene terephthalate is preferred.

If a stretchable woven fabric in which the side-by-side composite fiber yarns obtained as described above are used as at least either the warp yarns or the weft yarns requesting stretchability is used for producing the pants of this invention, remarkable effects can be obtained in wearing comfort, motion allowance, appearance, etc. In the case where the stretchable woven fabric is used as the garment fabric of the pants, it is preferred in view of wearing comfort and prevention of shape disfigurement that the extension rate at least in either the direction or the weft yarns direction is 10% to 40% at a load of 1.5 kg and that the extension recovery rate is 60% or higher.

The extension rate expresses the degree of the extensibility of the woven or knitted fabric. If this value is larger, the worn pants can easily follow the movement of the wearer's body and they can be easily put on and taken off. If the garment fabric of the pants has an extension rate of lower than 10%, there is a problem that the worn pants are too tight to allow flexible movement, and on the contrary, if the extension rate is 40% or higher, there is a problem that the wearer's body silhouette is liable to be revealed not allowing the intended shape to be created, though the pants fit the wearer's body.

The extension recovery rate expresses the degree to which the fabric extended in response to the movement of the wearer's body can return to the original state quickly. If this value is larger, the shape disfigurement of the worn pants is small, and the shape of the pants not worn is not so different from the shape of the pants worn. In the pants of this invention, the extension recovery rate of the garment fabric is 60% or higher, preferably 80% or higher. If the extension recovery rate of the garment fabric is lower than 60%, the fabric is not recovered at the projected portions only of the wearer's body such as buttocks and knees, and the garment fabric remains extended to impair its appearance.

In the meantime, the extension rate is measured based on the strip method of the method A (extension at constant rate) of JIS L 1096 (Test Methods for General Woven Fabrics," and the extension recovery rate is measured based on the strip method of the method A (repeated extension at constant rate) of JIS L 1096 "Test Methods for General Woven Fabrics." The detailed test methods are described later for the examples.

In this invention, it is preferred that the size of the lining fabric 3 is set to correspond to 99% to 85% of the size of the garment fabric. The size of the lining fabric 3 refers to the width and/or the length of the lining fabric 3. If the size of the lining fabric 3 is set to correspond to 99% to 85% of the size of the garment fabric, the pants can be worn in such a state that the lining fabric 3 is rather pulled. So, the effect of supporting the buttocks can be enhanced. Further, since the dimensional difference from the garment fabric can be covered by the extension rate of the lining fabric, the lining fabric 3 can be kept extended in relation with the garment fabric and the wearer's body. The width and length of the lining fabric 3 in this case refer to the results of measuring the same segments on the paper pattern before the lining fabric is sewn to the garment fabric, as shown in FIG. 6. In the example of the back body portion shown in FIG. 6, the width ranges from the back center line 7 to the sideline 4, and the length ranges from the waistline to the crotch on the back center line. For example with regard to the width, the width of the garment fabric as C cm and the width of the lining fabric 3 as D cm are measured in reference to the same corresponding points, and the ratio is calculated. Further with regard to the length, for example, the length of the garment fabric is measured along the curve of the back center line 7 as E cm, and the length of the lining fabric 3, which is set to correspond to 99% to 85% of the size of the garment fabric, is measured as F cm, respectively at the positions sewn together. Then, the ratio is calculated. However, if the dimension of the lining fabric is less than 85% of the corresponding dimension of the garment fabric irrespective of whether it is width or length, the lining fabric 3 is twitched when the garment fabric and the lining fabric are sewn together, and the extra portion of the back body garment fabric 2 is wrinkled to greatly impair the appearance. Further, if the dimension of the lining fabric 3 is as large as or larger than that of the garment fabric, that is, if the dimension of the lining fabric corresponds to 100% or larger than that of the garment fabric, the effect of supporting the buttocks is lost, and the extra portion of the lining fabric 3 becomes wrinkled in relation with the wearer's body and the garment fabric, to remarkably impair the wearing comfort unpreferably.

Further, in the second embodiment of the pants of this invention, as shown in FIG. 7, left and right pocket patches 11 of the front body are attached in the respectively continuous regions ranging from the sidelines 4 to the placket front 9. The lining fabric 3 with a form almost like that of the first embodiment is overlaid on the pocket patches for sewing to form the pants of the second embodiment. When the lining fabric 3 is sewn, the lining fabric 3 can be sewn to the waistline as in the first embodiment, or the left and right front ends 12 of the lining fabric 3 can be sewn to the pocket patches 11 by overlaying the lining fabric on the pocket patches by 10 to 20 cm from the sidelines 4. In this case, not only the region corresponding to the back body but also the region corresponding to the sides and the front body can be supported. It is preferred that the pocket patches 11 used are formed of a slightly stretchable woven or knitted fabric. If a highly stretchable woven or knitted fabric is used, the pocket patches 11 are also stretched to suit the shape of the wearer's abdomen, and the effect of supporting the abdomen cannot be obtained. The slightly stretchable woven or knitted fabric referred to here particularly means a sleek fabric or a woven fabric used as a lining fabric, etc. It is preferred that the fabric has an extension rate of 10% or lower. The lining fabric 3 covers a region ranging from a buttock portion of a back body 2 of the pants through sidelines 4 to partial portions of a front body 1 of the pants such that left and right front ends 12 of the lining fabric 3 are substantially separated from each other. The pocket patches 11 are sewn at least at the sidelines 4 and the placket front 9, and the left and right front ends 12 of the lining fabric 3 are sewn to the pocket patches 11. Further, the overlying portions 13 consisting of the lining fabric 3 and the pocket patch 11 should be less than 10 cm when they are sewn together. The reason is that if the front ends 12 of the lining fabric 3 are sewn to the pocket patches 11 at positions of 10 cm or less from the pocket entrances, hands cannot be inserted into the pockets. Furthermore, if the left and right front ends 12 of the lining fabric 3 are overlaid on the pocket patches 11 by more than 20 cm, the lining fabric is attached almost near to the placket front, and as a result, the front body consists of overlapping fabrics that steam inside and are obstructive to the wearing comfort, though the situation depends on the size and design to some extent.

In both the first embodiment and the second embodiment of the pants of this invention, it is preferred that pieces of the lining fabric 3 attached inside the garment fabric are joined in the back body at least at one place or more and draped to suit the roundness of the buttocks. The draping refers to a method for three-dimensionally finishing a flat fabric to suit the lines of the wearer's body using darts, tucks, yokes, etc. If darts and tucks are contained in the waistline and the crotch, the lining fabric 3 can be attached to suit the roundness of buttocks. On the other hand, since plural sewing allowances are overlaid at the darts and tucks, the sewing allowances appear as level differences on the front side of the pants, to impair the appearance and also to impair the wearing comfort. Therefore, in this invention, it is preferred that the lining fabric 3 is divided into at least two or more pieces to suit the shape of the buttocks and that the pieces of the lining fabric 3 are sewn together to form a shaped lining fabric 3 to be attached to the pants. It is preferred to use highly extensible seams for sewing the pieces of the lining fabric 3 together. To obtain the highly extensible seams, it is preferred to use a sewing method allowing seams to follow the fabric such as zigzag sewing, flatlock sewing, overlock sewing or chain stitch sewing. Furthermore, it is also preferred to use highly extensible sewing machine threads such as polyester wooly yarns, nylon wooly yarns and Resilon yarns as the sewing yarns used for seaming. It is more preferred that highly extensible sewing machine threads are used to form highly extensible seams. On the other hand, fusion bonding without using sewing yarns is also an effective means for sustaining the extension rate.

Further, in the first and second embodiments of the pants of this invention, if a belt-like buttocks supporting patch 8 inclined obliquely upward from below the hipline of the back body toward the front body is attached to the lining fabric 3 attached inside the garment fabric, the effect of tightening the buttocks and sides can be enhanced. Meanwhile, the buttocks supporting patch can be attached by any method such as sewing, joining, adhesion or fusion bonding, but in view of washing durability, skin touch and working efficiency, sewing is preferred. Meanwhile, the buttocks supporting patch 8 can be attached between the garment fabric and the lining fabric 3 as shown in FIG. 5, but it can also be attached inside the lining fabric 3. Further, it is preferred that the ends of the buttocks supporting patch 8 are kept in contact with the waistline as shown in FIG. 2 in the first embodiment. This can enhance the effect of shaping the wearer's sides. On the other hand, in the second embodiment, as shown in FIG. 8, it is preferred that the ends of the buttocks supporting patch are kept in contact with the ends of the lining fabric. This can enhance the effect of shaping the wearer's abdomen.

The lining fabric 3 attached inside the garment fabric of the pants of this invention and the buttocks supporting patch 8 are not especially limited in material. However, considering the dimensional stability, the compatibility with the garment fabric, the invisibility of the lining fabric 3 from outside when the pants are worn, etc., it is preferred to use a woven or knitted fabric formed by using polyurethane fibers (elastic fibers) together with synthetic fibers such as polyamide fibers or polyester fibers as the lining fabric 3 and the buttocks supporting patch 8. Further, without using elastic fibers, a polyester-based stretchable woven fabric mainly composed of PPT can also be used. The weave is not especially limited. In the case of knitted fabric, the knitting method is not especially limited, but in view of retention of buttocks shape, a warp knitted fabric is more suitable than a weft knitted fabric.

As the lining fabric 3 and the buttocks supporting patch 8, it is preferred to use a woven or knitted fabric with an extension rate of 30 to 200% at a load of 1.5 kg at least in either the warp yarns direction or the weft yarns direction and with an extension recovery rate of 80% to 100% after 10 times of repeated extension. If the extension rate of the lining fabric 3 is lower than 30%, the extensibility is too small. So, when the pants are worn, since the lining fabric only is tight, they cannot be smoothly put on or taken off and are less comfortable to wear. If the lining fabric 3 and the buttocks supporting patch 8 are higher than 200% in extension rate, tightness and buttocks supporting effect are too low. Therefore, it is preferred that the lining fabric 3 and the buttocks supporting patch 8 are 30% or higher in extension rate at least in either the warp yarns direction or the weft yarns direction. More preferred is 50% or higher, and further more preferred is 70% or higher.

Further, as the lining fabric 3 and the buttocks supporting patch 8 of this invention, it is preferred to select a material with an extension recovery rate of 80% to 100%. If the extension recovery rate is lower than 80%, the lining fabric 3 only remains extended to disfigure the shape and the tightening effect declines with the increase of wearing times and washing times.

Furthermore, it is preferred to use a satin net with a bursting strength of 200 to 260 kPa as the material of the lining fabric 3. Further, it is preferred to use a power net with a bursting strength of 261 to 320 kPa as the buttocks supporting patch 8. It is preferred that the lining fabric 3 and the buttocks supporting patch 8 are almost equal to each other in extension rate and extension recovery rate, for such reasons that both are improved in following capability, that the stress felt by the wearer during wearing decreases and that such problems as seam damage are unlikely to occur. On the other hand, with regard to bursting strength, it is preferred that the bursting strength of the buttocks supporting patch 8 is higher than that of the lining fabric 3, for partially enhancing the effect of supporting the buttocks.

The bursting strength is measured according to the method A (Mullen method) of JIS L 1018 "Test Methods for Knitted Fabrics," as described later for the examples.

The satin net referred to here is a kind of warp knitted fabrics, and it is a material used for foundations in general, especially soft girdles and is densely meshed to show a satin-like smooth look and taste, being characteristically glossy on the surface. Further, the power net is also a kind of warp knitted fabrics, but is different from the satin net in knitting method, looking like a net. Since the power net is stronger than the satin net, it is mainly used for such controlling undergarments as brassieres and bodysuits. Therefore, it does not disfigure the buttocks shape. Therefore, it is the best to use the satin net with the slipperiness and the extension rate necessary as a lining fabric as the lining fabric 3 of this invention and to use the power net as the buttocks supporting patch 8 for reinforcing the support of the region ranging from the gluteal fold through the sides to the abdomen.

It is preferred that the width of the buttocks supporting patch 8 is gradually increased from a range of 4 to 7 cm on the back center line 7 as shown in FIG. 3 to a range of 5 to 10 cm at the front ends 12 on the front body. This form enhances the tightening and lifting effects for the region ranging from the gluteal fold through the sides to the abdomen.

If the width of the buttocks supporting patch 8 is wider, a higher supporting effect can be obtained. However, if a buttocks supporting patch 8 with a certain width of 10 cm or more is sewn to the region ranging from the back body to the front body, about one third of the buttocks are tightened by the buttocks supporting patch, and the roundness of the buttocks is liable to be disfigured. On the contrary, if a buttocks supporting patch 8 with a certain narrow width of less than 4 cm is sewn to the region ranging from the back body to the front ends on the front body, it fits narrow portions such as the gluteal fold, but it does not have a sufficient power to support a wide area including the wearer's sides and abdomen. Therefore, it is preferred that the buttocks supporting patch 8 is gradually increased in width from a range of 4 to 7 cm at the gluteal fold to a range of 5 to 10 cm at the front ends on the front body. With this constitution, without affecting the silhouette viewed from outside, the necessary portions can be tightened with a required minimum power to exhibit the intended buttocks supporting effect.

Further, for keeping the belt-like buttocks supporting patch 8 inclined obliquely upward from below the hipline of the back body toward the front body, it is preferred that the patch is inclined not like straight lines but like curves swelling downward as shown in FIGS. 2 to 4 or like S-shaped curves in the case where the patch is sewn to the ends of the lining fabric as shown in FIG. 8. Further, if the back body portion of the buttocks supporting patch 8 is curved to suit the hipline, particularly like W shape with roundness when viewed from the back as shown in FIG. 3, the buttocks can be shaped without disfiguring the roundness of buttocks.

On the other hand, in the third embodiment of the pants of this invention, as shown in FIG. 9, the lining fabric 3 and the belt-like abdomen suppressing patch 16 are attached to the pants without the placket front 9 such as jersey pants, training pants or pajama pants respectively with rubber inserted into the waist portion entirely or partially.

The lining fabric 3 covers the region ranging from the buttock portion of the back body 2 through the sidelines 4 to partial portions of the front body 1, and it is preferred to attach a belt-like buttocks supporting patch 8 as in the first and second embodiments of the pants of this invention. Further, as shown in FIGS. 9 and 10, the belt-like abdomen suppressing patch 16 can be joined to the lining fabric 3 at the crotch 6, and the other end of the patch 16 can be joined at the waistline 5. If the abdomen suppressing patch 16 is not formed like a belt but formed to cover the front body as a whole, it is too tight at the abdomen and is inconvenient to put on and to take off. Therefore, it is preferred that the abdomen suppressing patch 16 is formed like a belt.

Further, it is preferred that the width of the belt-like abdomen suppressing patch 16 gradually increases from a range of 8 to 15 cm at the crotch 6 to a range of 12 to 25 cm at the waistline 5. It is not preferred that the width at the waistline 5 is narrower than 12 cm, since the abdomen as a whole cannot be supported. Further, it is not preferred that the width at the waistline 5 is larger than 25 cm for such reasons that the area of the patch 16 overlying on the lining fabric 3 attached to the region ranging from the back body to partial portions of the front body is too large, that the wearing comfort is impaired and that the level difference between the lining fabric 3 and the abdomen suppressing patch 16 can be seen from outside the pants to impair the appearance.

Moreover, it is preferred that the belt-like abdomen suppressing patch 16 is made of the same material as that of the lining fabric 3 and/or the buttocks supporting patch 8. It is not preferred that the abdomen suppressing patch 16 and the lining fabric 3 are different from each other in material for such reasons that the joint at the crotch 6 is liable to break since they are different in material properties such as extension rate, extension recovery rate and thickness and that different touches may be felt between the front body and the back body. Further, to enhance the abdomen supporting effect of the abdomen suppressing patch 16, it is preferred that a satin net or a power net is partially or wholly sewn as in the first and second embodiments of the pants of this invention.

In this invention, the buttocks supporting effect can be confirmed as described below. At first, according to instructions, a wearer wears pants and stands beside a measure with graduations for the region from the floor surface to the position of the wearer's waist, and a camera, preferably a digital camera is used to take a photograph from a wearer's side. Then, on a personal computer, the distance from the floor surface to the buttocks vertex is measured. The position of the buttocks vertex varies depending on the material, size and design of the garment fabric of the pants. So, if pants of quite the same material, size and design are used for comparison, the difference in the position of the buttocks vertex based on the presence or absence of the lining fabric 3 can be expressed as a dimensional difference. Of course the same wearer should be used.

Further, if the garment pressures at various regions are measured, the effect can be confirmed. The garment pressure can be measured by the method described later for the examples.

EXAMPLES

This invention is described below more particularly in reference to examples and comparative examples, but is not limited thereto or thereby. Meanwhile, the following methods were used to evaluate the qualities of the garment fabrics and lining fabrics of pants used in the examples and comparative examples.

(Measuring Methods)

(1) Extension Rate

The extension rate of a garment fabric or a lining fabric was measured according to the strip method of the method A (extension at constant rate) of JIS L 1096 "Test Methods for General Woven Fabrics."

At first, each three 5 cm×30 cm specimens were obtained in the warp yarns direction and the weft yarns direction. For measurement, a constant rate elongation tensile tester with an automatic recorder was used, and a specimen was clipped and fixed with a distance of 20 cm without looseness and tension, and extended at a stress rate of 20 cm/min to 14.7 N (1.5 kg), to measure the inter-clip distance. The elongation rate LA (%) was obtained from the following formula. The mean value of three specimens was obtained.

$$\text{Extension rate } LA(\%)=[(L1-L)/L]\times 100$$

L: inter-clip distance (mm)

L1: inter-clip distance after extension to 14.7 N (mm)

(2) Extension Recovery Rate

The extension recovery rate of a garment fabric or a lining fabric was measured according to the strip method of the method A (repeated extension at constant rate) of JIS L 1096 "Test Methods for General Woven Fabrics."

At first, each three 5 cm×30 cm specimens were obtained in the warp yarns direction and the weft yarns direction. For measurement, a constant rate elongation tensile tester with an automatic recorder was used, and a specimen was clipped and fixed with a distance of 20 cm without looseness and tension. The specimen was extended at a stress rate of 20 cm/min to 80% of the value of the extension rate (the previous item, LA) obtained separately, allowed to stand for 1 minute, returned to the original position at the same rate, and allowed to stand for 3 minutes. This operation was repeated 10 times, and subsequently, the specimen was extended again to a load larger than the initial load at the same rate. A load-extension curve was recorded, and the residual extension was measured from the curve. The extension recovery rate LB (%) was obtained from the following formula. The mean value of three specimens was obtained.

$$\text{Elongation recovery rate } LB(\%)=[(Lb1-Lb)/Lb]\times 100$$

Lb: Length of the specimen extended to 80% of the extension rate LA on the chart (mm)

Lb1: Length of the specimen corresponding to the residual extension after 10 times of repeated extension on the chart (mm)

(3) Bursting Strength

The bursting strength of a lining fabric was measured according to the method A (Mullen method) of JIS L 1018 "Test Methods for Knitted Fabrics."

At first, five 15 cm×15 cm specimens were obtained. A specimen with its right side turned upward was installed at the clip of a Mullen burst tester in an ordinary state without applying tension. A pressure fluid was increased at a rate of 98±4 $cm^3$/min, and at the moment when the rubber film burst through the specimen, the pressurization was stopped to read the pressure at that moment. In succession, the clip was loosened and the specimen was removed, when the pressure of the rubber film indicated by the needle was read. The bursting strength was calculated from the following formula. The mean value of five specimens was obtained.

$$\text{Bursting strength(kPa)}=a-b$$

a: Pressure at the moment when the rubber film burst through the specimen b: Pressure of the rubber film after removing the specimen (4) Position of the Buttocks Vertex As described before in this specification, the pants worn were photographed by a camera from a wearer's side, and the distance from the floor surface to the buttocks vertex was measured on a personal computer. Wearing, photographing and measurement were performed three times, and the mean value was obtained. Since the vertex could vary depending on the material, size and design of pants, pants with quite the same material, size and design were worn for comparison, to express the difference in the position of buttocks vertex based on the presence or absence of the lining fabric as a dimensional difference. Always the same wearer was used.

Meanwhile, with regard to the buttocks vertex, an auxiliary line was drawn on the image of the wearer's side from a height corresponding to the top of the head to the floor surface vertically, and the intersection at the buttocks was obtained as the buttocks vertex.

(5) Measurement of Garment Pressure

Air pack sensors as contact pressure measuring devices produced by K.K. AMI were stuck to the buttocks vertex, gluteal fold (border between buttocks and thighs) and a side of the wearer, three places in total. The wearer wore pants, stayed stationary for 30 seconds and bent her body forward for 30 minutes, to measure the changing garment pressures. The garment pressure, measurement was performed three times, and the mean value was obtained. Since the value could vary depending on the material, size and design of pants, the same wearer wore pants with the same material, size and design, to obtain the difference of the garment pressures (kPa) based on the presence or absence of the lining fabric. At the respective places of measurement, each garment pressure was evaluated in reference to the three-step criterion shown in Table 1.

(6) Evaluation of Such States as Aesthetic Quality, Wearing Comfort and Skin Touch Monitors wore produced pants and sensory-evaluated aesthetic quality, wearing comfort, motion allowance, buttocks supporting effect, and abdomen suppressing effect. The evaluation criteria are shown in Table 1.

Ten female monitors of 20s to 50s in age were instructed to wear, and the mean value was obtained for each of the evaluation items. The sum of the mean values of respective evaluation items was obtained as the overall evaluation. A larger overall evaluation value means more excellent evaluation.

fibers with nylon were knitted using a Raschel machine, to obtain a 6-course satin net. It was used as the lining fabric. The lining fabric had an extension rate of 147% in the warp yarns direction, an extension rate of 41% in the weft yarns direction, an extension recovery rate of 96% in the warp yarns direction, an extension recovery rate of 85% in the weft yarns direction, and a bursting strength of 240 kPa. The garment fabric and the lining fabric were sewn together in the following process, to obtain the lady's pants shown in FIG. 1.

At first, the lining fabric was cut to have a form of inclining obliquely upward from the back body to the waistline of the front body. Further, a curved belt-like buttocks supporting patch adapted to the shape of buttocks gradually increasing in width from 5 cm at the back center line to 8 cm at the waistline of the front body was sewn to one side of the lining fabric by a lockstitch zigzag sewing machine, using a nylon wooly yarn as the bobbin thread, lest the extension should be prevented. The buttocks supporting patch used was a power net having an extension rate of 156% in the warp yarns direction, an extension rate of 53% in the weft yarns direction, an extension recovery rate of 96% in the warp yarns direction, an extension recovery rate of 94% in the weft yarns direction and a bursting strength of 290 kPa. The lining fabric having said buttocks supporting patch sewn to it was sewn to the garment fabric sewn in the form of pants at the crotch and the waistline in such a manner that the buttocks supporting patch was kept in contact with the garment fabric.

TABLE 1

| Marks | Aesthetic quality | Wearing comfort | Abdomen tightening effect | Motion allowance | Buttocks supporting effect*1 | Garment pressure*2 | | |
|---|---|---|---|---|---|---|---|---|
| | | | | | | Buttocks vertex | Gluteal fold | Side |
| 3 | The lining fabric is not noticeable from outside. The wearer's body line is not noticeable. | The pants fit the wearer's body and are comfortable to wear. | Moderate tightness can be felt. | The wearer can easily move. | 2 cm or more | 0.1 kPa or less | 1.0 kPa or more | 1.0 kPa or more |
| 2 | The lining fabric is somewhat noticeable from outside. The wearer's body line is rather noticeable. | The pants do not rather fit the wearer's body and stress the wearer. | The wearer rather feels tightness. | The wearer cannot so easily move. | 1 to less than 2 cm | 0.2 kPa or less | 0.5 kPa or more | 0.5 kPa or more |
| 1 | The lining fabric is noticeable from outside. The wearer's body line is noticeable. | The pants do not fit the body and are uncomfortable or very tight to wear. | The wearer does not feel abdomen tightening effect at all. | The wearer cannot easily move. | Less than 1 cm | 0.3 kPa or more | 0.4 kPa or less | 0.4 kPa or less |

*1Buttocks supporting effect: Pants of the same material, design and size were prepared, and as instructed, the same person wore them, to measure the dimensional difference at the vertex position of buttocks based on the presence or absence of the lining fabric.
*2Garment pressure: Garment pressure difference at each region

Example 1

Two-plied cotton yarns of yarn count 60 were used as warp yarns and PPT yarns of 165 decitexes were used as weft yarns, to form a 2/1 twill weave, and it was dyed. The woven fabric obtained like this had an extension rate of 8% in the warp yarns direction, an extension rate of 25% in the weft yarns direction, an extension recovery rate of 92% in the warp yarns direction and an expansion recovery rate of 85% in the weft yarns direction. This woven fabric was used as the garment fabric. Further, yarns obtained by covering polyurethane The sewing specifications of the lady's pants are shown in Table 2, and the results of evaluating the aesthetic quality, wearing comfort, motion allowance, buttocks supporting effect and abdomen suppressing effect of the pants as they were worn are shown in Table 3.

Example 2

Two-plied cotton yarns of yarn count 50 were used as warp yarns and yarns obtained by covering elastic yarns of 44 decitexes with a cotton yarn of yarn count 50 respectively were used as weft yarns, to form a plain weave, and it was dyed. The woven fabric obtained like this had an extension rate of 12% in the warp yarns direction, an extension rate of 28% in the weft yarns direction, an extension recovery rate of 85% in the warp yarns direction and an expansion recovery rate of 65% in the weft yarns direction. This woven fabric was used as the garment fabric. The same satin net as used in Example 1 was used as the lining fabric, and the garment fabric and the lining fabric were sewn together in the following process, to obtain the man's pants shown in FIG. 7.

At first, a sleek fabric with an extension rate of 3% in both the machine and weft yarns directions was used as the pocket patches of the pants. They were sewn and seamed to the wrong side c of the garment fabric sewn in the form of pants in the regions ranging from the sidelines to the placket front. Then, the lining fabric was cut in the form of inclining obliquely upward from the back body toward the waistline of the front body, and a buttocks supporting patch formed of the same power net as used in Example 1 was sewn to one side of the lining fabric, to have the form of inclining obliquely upward from below the hipline toward the front body. The buttocks supporting patch was a curved belt gradually increasing in width from 7 cm at the back center line to 10 cm at the left and right front ends. It was sewn to the lining fabric by a lockstitch zigzag sewing machine, using a nylon wooly yarn as the bobbin thread lest the extension should be prevented. The lining fabric having the buttocks supporting patch sewn to it was sewn to the garment fabric at the crotch and the waistline in such a manner that the buttocks supporting patch was kept in contact with the garment fabric and further overlaid on the pocket patches by 15 cm each.

The sewing specifications of the man's pants obtained as described above are shown in Table 2, and the results of evaluating the aesthetic quality, wearing comfort, motion allowance, buttocks supporting effect and abdomen suppressing effect of the pants as they were worn are shown in Table 3.

Example 3

Mixed yarns consisting of polyethylene terephthalate and rayon were used as warp yarns and yarns obtained by covering elastic yarns of 44 decitexes with a mixed yarn consisting of polyethylene terephthalate and rayon respectively were used as weft yarns, to form a 3/1 satin weave, and it was dyed. The woven fabric was used as the garment fabric, to produce the lady's pants shown in FIG. 7 by sewing. The woven fabric had an extension rate of 21% in the warp yarns direction, an extension rate of 20% in the weft yarns direction, an extension recovery rate of 91% in the warp yarns direction and an extension recovery rate of 89% in the weft yarns direction. Further, a satin net knitted using polyamide fibers with polyvinyl pyrrolidone kneaded in them and polyurethane fibers was used as the lining fabric, and a power net was used as the buttocks supporting patch. The satin net had an extension rate of 180% in the warp yarns direction, an extension rate of 104% in the weft yarns direction, an elongation recovery rate of 92% in the warp yarns direction, an elongation recovery rate of 94% in the weft yarns direction and a bursting strength of 226 kPa. The power net had an extension rate of 109% in the warp yarns direction, an extension rate of 85% in the weft yarns direction, an elongation recovery rate of 97% in the warp yarns direction, an elongation recovery rate of 89% in the weft yarns direction and a bursting strength of 280 kPa. A sleek fabric with an extension rate of 3% in both the warp yarns and weft yarns directions was used as the pocket patches of the pants. It was sewn and seamed to the wrong side of the garment fabric sewn in the form of pants in the regions ranging from the sidelines to the placket front. The lining fabric was designed to correspond to 93% of the garment fabric in the width direction and to 96% of the garment fabric in the length above the crotch and to have a form covering the region ranging from the back body to partial portions of the front body. It was divided into four sections in the width direction and into two sections in the length direction above the crotch. The seam lines of these pieces were curved, and the pieces were sewn together at the seam lines by zigzag sewing in such a manner that the pants were draped. When the pieces of the lining fabric were sewn together, reinforcing tapes obtained by cutting the same power net as used for the buttocks supporting patch to have a width of 1 cm were sewn to the seam lines on the back side for preventing the possible damage during wearing. Further, a belt-like buttocks supporting patch for the region ranging from below the hipline toward the waistline of the front body was sewn to the lining fabric by a lockstitch zigzag sewing machine, using a nylon wooly yarn as the bobbin thread, lest the extension should be prevented. The buttocks supporting patch was a curved belt gradually increasing in width from 5 cm at the back center line to 8 cm at the left and right front ends. The lining fabric having the buttocks supporting patch sewn to it was sewn to the garment fabric at the crotch and the waistline in such a manner that the buttocks supporting patch was kept in contact with the garment fabric and overlaid on the pocket patches by 18 cm each. Further, the same power net as used for the buttocks supporting patch was cut to make fasteners with a width of 2 cm and a length of 4 cm, and they were sewn to the lining fabric respectively at the places corresponding to the side seams of the garment fabric.

The sewing specifications of the lady's pants obtained as described are shown in Table 2, and the results of evaluating the aesthetic quality, wearing comfort, motion allowance, buttocks supporting effect and abdomen suppressing effect of the pants as they were worn are shown in Table 3.

Example 4

A two-plied cotton yarn of yarn count 50 as a warp yarn and a yarn obtained by covering an elastic yarn of 44 decitexes with a cotton yarn of yarn count 50 as a weft yarn were alternately used for being knitted by a 22 G interlock circular knitting machine. The interlock tubular knitted fabric was dyed according to the dyeing method for ordinary tubular knitted fabrics. The knitted fabric obtained as described above had an extension rate of 60% in the warp yarns direction and an extension rate of 105% in the weft yarns direction, an extension recovery rate of 65% in the warp yarns direction and an extension recovery rate of 75% in the weft yarns direction. The knitted fabric was used as the garment fabric. A lining fabric was sewn to the garment fabric according to the following process, to produce the lady's pants shown in FIG. 1.

At first, the lining fabric used in Example 3 was cut to have the form of inclining obliquely upward from the back body to the waistline of the front body. Further, a buttocks supporting patch was sewn to one side of the lining fabric using a two-needle flatlock machine, using nylon wooly yarns as wrong side fancy yarns, lest the extension should be prevented. The buttocks supporting patch was the same power net as used in Example 3, which was a curved belt gradually increasing in width from 7 cm at the back center line to 9 cm at the waistline of the front body. The lining fabric having the buttocks supporting patch sewn to it was sewn to the garment fabric at the crotch and the waistline in such a manner that the buttocks supporting patch was kept in contact with the garment fabric.

The sewing specifications of the lady's pants obtained as described above are shown in Table 2, and the results of evaluating the aesthetic quality, wearing comfort, motion allowance, buttocks supporting effect and abdomen suppressing effect of the pants as they were worn are shown in Table 3.

Example 5

The woven fabric used in Example 4 was used as the garment fabric, and a 2 cm wide flat rubber was inserted into the waist portion, to product the lady's pants without front opening as shown in FIG. 9 by sewing. Then, the same satin net as used in Example 1 was cut to have the form of inclining obliquely upward from the back body toward the waistline of the front body, and used as the lining fabric. Further, the same satin net as used in Example 1 was cut to be a belt gradually increasing in width from 10 cm at the crotch to 22 cm at the waistline of the front body, to be used as the abdomen suppressing patch. The lining fabric and the abdomen suppressing patch were joined to the garment fabric at the crotch using an overlock machine and further sewn to the garment fabric at the waistline.

The lady's pants obtained as described above were high in aesthetic quality, wearing comfort, motion allowance, buttocks supporting effect and the effect of tightening the region ranging from the abdomen to the sides.

Comparative Example 1

The woven fabric used in Example 1 was used as the garment fabric, to produce the same lady's pants as those of Example 1 by sewing. However, neither the lining fabric nor the buttocks supporting patch was attached.

The sewing specifications of the lady's pants obtained as described above are shown in Table 2, and the results of evaluating the aesthetic quality, wearing comfort, motion allowance, buttocks supporting effect and abdomen suppressing effect of the pants as they were worn are shown in Table 3.

Comparative Example 2

Spun cotton yarns of yarn count 30 were used as warp yarns and weft yarns, to form a 3/1 satin weave, and it was dyed. The woven fabric was used as the garment fabric, to produce man's pants by sewing. The woven fabric had an extension rate of 5% in the warp yarns direction, an extension rate of 6% in the weft yarns direction, an extension recovery rate of 98% in the warp yarns direction and an extension recovery rate of 98% in the weft yarns direction. The same fabric as the garment fabric was used as the pocket patches, and the front ends of the pocket patches were not sewn to the placket front. A tricot knitted fabric having an extension rate of 99% in the warp yarns direction, an extension rate of 72% in the weft yarns direction, an extension recovery rate of 67% in the warp yarns direction and an extension recovery rate of 73% in the weft yarns direction was sued as the lining fabric. The lining fabric was cut to have the form covering only the buttocks of the back body, and it was sewn to the garment fabric at the crotch and the sidelines. Further, a 20 cm belt-like buttocks supporting patch was sewed to the lining fabric below the hipline by a lockstitch zigzag sewing machine, using a nylon wooly yarn as the bobbin thread, lest the extension should be prevented. Meanwhile, a power net having an extension rate of 156% in the warp yarns direction, an extension rate of 53% in the weft yarns direction, an extension recovery rate of 96% in the warp yarns direction and an extension recovery rate of 94% in the weft yarns direction was used as the buttocks supporting patch.

The sewing specifications of the man's pants obtained as described above are shown in Table 2, and the results of evaluating the aesthetic quality, wearing comfort, motion allowance, buttocks supporting effect and abdomen suppressing effect of the pants as they were worn are shown in Table 3.

Comparative Example 3

Long fiber yarns of 100% polyethylene terephthalate yarns of 56 decitexes were knitted by a 20 G circular knitting machine, and the knitted fabric was dyed as usual. The knitted fabric obtained as described above had an extension rate of 40% in the warp yarns direction, an extension rate of 80% in the weft yarns direction, an extension recovery rate of 88% in the warp yarns direction and an extension recovery rate of 55% in the weft yarns direction. The knitted fabric was used as the garment fabric, to produce pants as jersey pants without opening with a rubber inserted in the waist portion. A power net with an extension rate of 109% in the warp yarns direction, an extension rate of 85% in the weft yarns direction, an extension recovery rate of 97% in the warp yarns direction and an extension recovery rate of 87% in the weft yarns direction was used as the lining fabric. It was sewn to cover the back body and the front body in the region above the crotch like a girdle, and sewn to the garment fabric at the waist rubber portion.

The sewing specifications of the lady's pants obtained as described above are shown in Table 2, and the results of evaluating the aesthetic quality, wearing comfort, motion allowance, buttocks supporting effect and abdomen suppressing effect of the pants as they were worn are shown in Table 3.

TABLE 2

| | Garment fabric (pants proper) | | | Lining fabric (lining fabric of pants) | | | Pocket patches | |
|---|---|---|---|---|---|---|---|---|
| | Yarns used | Weave | Mixing rates (wt %) | Whether or not a lining fabric was used | Whether or not a buttocks supporting patch was used (width of patch) | (1) Position of lining fabric (2) Whether or not fasteners were used | Form of front pocket patches (material) | Whether or not the pocket patches were fixed to the lining fabric (overlying length) |
| Example 1 | Warp: Two-plied cotton yarns of yarn count 60 Weft: PPT of 165 dtex | 2/1 twill | PPT: 50 C: 50 | Used | Used (5 cm at back center and 8 cm at front waistline) | (1) From back body to partial portions of front body (2) No fasteners | Ordinary pocket patches to which the ends of lining fabric were not sewn (the same fabric as that of the garment fabric) | Not fixed |

TABLE 2-continued

| | Garment fabric (pants proper) | | | Lining fabric (lining fabric of pants) | | | Pocket patches | |
|---|---|---|---|---|---|---|---|---|
| | Yarns used | Weave | Mixing rates (wt %) | Whether or not a lining fabric was used | Whether or not a buttocks supporting patch was used (width of patch) | (1) Position of lining fabric (2) Whether or not fasteners were used | Form of front pocket patches (material) | Whether or not the pocket patches were fixed to the lining fabric (overlying length) |
| Example 2 | Warp: Two-plied cotton yarns of yarn count 60 Weft: Cotton yarns of yarn count 50 + LYCRA of 44 dtex | Plain weave | C: 97 LY: 3 | Used | Used (7 cm at back center and 10 cm at front ends) | (1) From back body to partial portions of front body (2) No fasteners | Pocket patches reached the placket front (sleek fabric) | Fixed (15 cm) |
| Example 3 | Warp: PET/rayon Weft: PET/rayon + LYCRA of 44 dtex | 3/1 satin | PET: 65 R: 28 LY: 7 | Used | Used (5 cm at back center and 8 cm at front ends) | (1) From back body to partial portions of front body (the lining fabric was divided into pieces that were then sewn together) (2) Fasteners were used. | Pocket patches reached the placket front (sleek fabric) | Fixed (18 cm) |
| Example 4 | Two-plied cotton yarn of yarn count 50 Cotton yarn of yarn count 50 + LYCRA of 44 dtex, one each yarn alternately | Interlock tubular knitted fabric | C: 90 LY: 10 | Used | Used (7 cm at back center and 9 cm at front waistline) | (1) From back body to partial portions of front body (2) Fasteners were used. | Ordinary pocket patches to which the ends of lining fabric were not sewn (the same fabric as that of the garment fabric) | Not fixed |
| Example 5 | Two-plied cotton yarn of yarn count 50 Cotton yarn of yarn count 50 + LYCRA of 44 dtex, one each yarn alternately | Interlock tubular knitted fabric | C: 90 LY: 10 | Used | Not used | (1) From back body to partial portions of front body (2) No fasteners | Not used | Not fixed |
| Comp. Example 1 | Warp: Two-plied cotton yarns of yarn count 60 Weft: PPT of 165 dtex | 2/1 twill | PPT: 50 C: 50 | Not used | Not used | (1) No lining fabric (2) No fasteners | Ordinary pocket patches to which the ends of lining fabric were not sewn (the same fabric as that of the garment fabric) | Not fixed |
| Comp. Example 2 | Spun cotton yarns of yarn count 30 | 3/1 satin | C: 100 | Used | Used (width 20 cm) | (1) Back body only (2) No fasteners | Ordinary pocket patches to which the ends of lining fabric were not sewn (the same fabric as that of the garment fabric) | Not fixed |
| Comp. Example 3 | 56 dtex PET | Plain switch | PET: 100 | Used | Not used | (1) Front and back bodies (like girdle) (2) No fasteners | Not used | Not fixed |

Note:
PET = polyethylene terephthalate,
PPT = polytrimethylene terephthalate,
C = cotton,
LY = "LYCRA" (registered trademark),
R = Rayon

TABLE 3

| | | | Abdomen | | Buttocks | Garment pressure | | | |
|---|---|---|---|---|---|---|---|---|---|
| | Aesthetic quality | Wearing comfort | tightening effect | Motion allowance | supporting effects | Buttocks vertex | Gluteal fold | Side | Total Evaluation |
| Example 1 | 3 | 3 | 2 | 3 | 3 | 3 | 2 | 2 | 21 |
| Example 2 | 3 | 3 | 3 | 3 | 3 | 2 | 3 | 3 | 23 |
| Example 3 | 3 | 3 | 3 | 3 | 3 | 2 | 3 | 3 | 23 |
| Example 4 | 3 | 3 | 2 | 3 | 3 | 3 | 2 | 2 | 21 |
| Comparative Example 1 | 1 | 3 | 1 | 3 | 1 | 1 | 1 | 1 | 12 |
| Comparative Example 2 | 2 | 2 | 2 | 2 | 2 | 2 | 1 | 1 | 14 |
| Comparative Example 3 | 1 | 1 | 1 | 2 | 2 | 1 | 2 | 2 | 12 |

INDUSTRIAL APPLICABILITY

The pants of this invention look like ordinary pants and can be used as pants with a buttocks supporting effect and excellent wearing comfort. They can also be used as pants with an abdomen shaping effect in addition to the buttocks supporting effect.

The invention claimed is:

1. Pants comprising:

a garment fabric comprising a waistline, a front body, two side seams, a back body having a hipline and having a buttocks portion, and a crotch having a crotch front area and a crotch rear area; and an inner lining fabric, wherein said lining fabric covers a region ranging from the buttocks portion of the back body of the garment fabric through both of the side seams to partial portions of the front body of the pants such that left and right front ends of the lining fabric are separated from each other and the inner lining is attached inside the garment fabric of the front and back bodies, wherein portions of the lining fabric are joined to the back body of the garment fabric by highly extensible seams and/or highly extensible threads, wherein the lining fabric extends from the crotch rear area to the waistline, the garment fabric and the lining fabric are joined to each other at partial portions of the waistline and at partial portions of the crotch, and the garment fabric and the lining fabric are sewn or fastened to partial portions of the side seams of the garment fabric through fasteners which are moveable with respect to the garment fabric, wherein a width of the lining fabric is set to correspond to 99% to 85% of that of the garment fabric, wherein a belt-like buttocks supporting patch inclining obliquely upward from below the hipline of the back body of the garment fabric toward the front body of the garment fabric is attached to the lining fabric, a width of said buttocks supporting patch gradually increasing from a range of 4 to 7 centimeters at a back center of said buttocks supporting patch to a range of 5 to 10 centimeters at ends of said buttocks supporting patch on the front body of the garment fabric, said buttocks supporting patch terminating at the crotch rear area of the garment fabric, said lining fabric and buttocks supporting patch having extension rates in a range from 30 to 200% and extension recovery rates in a range from 80 to 100%, and said lining fabric and buttocks supporting patch being almost equal to each other in extension rate and extension recovery rate, and wherein said garment fabric and/or lining fabric is a woven or knitted fabric stretchable in a warp yarns direction and/or in a weft yarns direction.

2. Pants, according to claim 1, wherein at least one of a warp yarn or a weft yarn of the garment fabric and/or the lining fabric is a polyester-based stretchable woven fabric in which composite multi-filaments, each consisting of a polyester mainly composed of polytrimethylene terephthalate and another polyester, is bonded to each other side by side to extend in a filament length direction.

3. Pants, according to claim 1, wherein a satin net with a bursting strength of 200 to 260 kPa is used as the lining fabric and a power net with a bursting strength of 261 to 320 kPa is used as the buttocks supporting patch.

* * * * *